US005934237A

United States Patent [19]

Vilou

[11] Patent Number: 5,934,237

[45] Date of Patent: Aug. 10, 1999

[54] METHODS AND SYSTEMS FOR CONTROLLING THE AUTOMATIC CUT-OFF OF A MOTOR VEHICLE STARTER

[75] Inventor: Gérard Vilou, Tassin, France

[73] Assignee: Valeo Equipments Electriques Moteur, Creteil, France

[21] Appl. No.: 08/988,588

[22] Filed: Dec. 11, 1997

[30] Foreign Application Priority Data

Dec. 13, 1996 [FR] France ..... 96 15342

[51] Int. Cl.[6] ..... F02N 11/08

[52] U.S. Cl. ..... 123/179.3; 290/38 R

[58] Field of Search ..... 123/179.3, 179.2, 123/179.4; 290/38 R, 38 C

[56] References Cited

U.S. PATENT DOCUMENTS

| | | | |
|---|---|---|---|
| 4,198,945 | 4/1980 | Eyermann et al. | 123/179.3 |
| 4,947,051 | 8/1990 | Yamomoto et al. | 290/38 R |
| 5,601,058 | 2/1997 | Dyches et al. | 123/179.2 |

FOREIGN PATENT DOCUMENTS 58-123479 7/1983 Japan .

OTHER PUBLICATIONS

Patent Abstracts of Japan vol. 015, No. 433 (P–1271), Nov. 5, 1991 and JP 03 108785 A (Canon Inc), Aug. 6, 1991.

French Search Report, August 29, 1997 for application 9615342.

*Primary Examiner*—Andrew M. Dolinar
*Attorney, Agent, or Firm*—Morgan & Finnegan LLP

[57] ABSTRACT

A motor vehicle starter is cut out automatically as soon as the engine is running by itself. The cut-out is controlled by a method in which the starter supply voltage is measured and the starter is cut out when this voltage reaches a threshold value. On closing of the ignition switch, but before any power is supplied to the starter, the starter supply voltage is measured for several values of current in at least one circuit in the wiring network of the vehicle connected to the vehicle battery. The value of the threshold voltage is then calculated from these measurements, as a function of parameters that characterize the electrical circuitry of the vehicle at the time of starting the engine, at least one of these parameters being capable of being determined from the current measurements.

18 Claims, 1 Drawing Sheet

METHODS AND SYSTEMS FOR CONTROLLING THE AUTOMATIC CUT-OFF OF A MOTOR VEHICLE STARTER

FIELD OF THE INVENTION

The present invention relates to methods and apparatus (also referred to as systems) for controlling the automatic cut-off, or stopping, of a starter for a motor vehicle engine.

BACKGROUND OF THE INVENTION

In current practice, it is usual for the operation of driving the engine of a vehicle by means of its starter to be terminated under the control of the driver of the vehicle, who for this purpose releases the ignition key when the engine makes a characteristic sound. However, vehicle engines are tending nowadays to be made more and more quiet, thus making it increasingly difficult for the driver to hear the characteristic sound and therefore more difficult to know when to release the ignition key. As a result, the release of the key tends to be delayed, so that the starter and the engine are subjected to unnecessary, and severe forces.

Numerous control systems for the automatic stopping of the starter are known, which employ an analysis of voltage or current signals to determine when the engine has started, that is to say the instant when it becomes autonomous enough to reach its slow running mode by itself, this being the instant at which the starter is no longer required and should be stopped. In particular, it is known from French patent specification No. FR 2 696 417 to control cut-off of the starter by comparing the battery voltage with a threshold voltage, the starter being cut-off when the voltage of the battery reaches this threshold value. From the point of view of the number of components used and the cost of the components, analysis of the voltage signal is preferred to analysis of the current signal.

However, control of cut-off by comparison with a threshold voltage, such as is described in specification FR 2 696 417, is not fully satisfactory. In particular, the voltage across the battery terminals can vary considerably over time, as a function in particular of its state of maintenance or of the ambient temperature. As a result, if the battery voltage is too low, it can happen that the starter is not stopped immediately after the engine has successfully started, and operates well beyond the time that is actually necessary.

On the other hand, if the battery voltage is too high, it can happen that the starter is cut off too soon, well before the engine has properly started.

DISCUSSION OF THE INVENTION

An object of the invention is to overcome these drawbacks. It has previously been proposed by the company Valeo Equipements Electriques Moteur, in the specification of its French patent application No. FR 96 03511, to make the voltage corresponding to the threshold for starter cut-off dependent on a previous measurement of the open circuit voltage of the battery, and also, optionally on temperature.

The present invention proposes a method of controlling the automatic stopping of the starter which is even more precise, and which takes into account the characteristics of the battery, such as state of charge, battery temperature and battery capacity, as well as the resistance of the wiring between the battery and the starter and the variations due to the current absorbed by other elements of the vehicle that use electric current, such as the heating and ventilating system, the lighting systems and so on.

The control system proposed by the invention has the further advantage that it does not call for high computing power, and that it can be put into practice using standard electronic components.

According to the invention in a first aspect, a method for controlling the automatic stopping of a motor vehicle starter, in which the power supply voltage of the starter is measured and the power supply to the starter is interrupted when the said voltage reaches a threshold value, is characterised in that, on closure of the ignition switch of the vehicle, and before power is supplied to the starter, the power supply voltage is measured for several values of current intensity in at least one branch of the electrical wiring system (or network) of the vehicle connected to the power supply battery of the vehicle, and the value of the threshold voltage is the calculated from these measurements, as a function of parameters that characterise the electrical network of the vehicle at the time of the starting operation, with at least one of the said parameters being capable of being determined from the said measurements.

Preferably, for the measurement of the power supply voltage, prior to supply of power to the starter being commenced, the current in the wiring is controlled in such a way as to impose on the wiring system a plurality of given values of current.

In another version, where the power supply to the starter is controlled by a relay having at least one relay winding, the measurements of voltage carried out prior to supply of power to the starter are performed, for a plurality of values of current intensity in the circuit that supplies power to the relay winding or windings, while the current is rising in the latter.

In a preferred embodiment, at least three voltage measurements are carried out corresponding to three different values of current intensity in the said circuit.

For computation of the threshold voltage, the method preferably includes the step of determining, from the voltage measurements, at least one parameter such as the electromotive force of the battery of the vehicle, and/or the internal resistance of the battery, and/or the equivalent resistances of other current-consuming elements in the electrical network of the vehicle.

In a second aspect, the invention provides apparatus adapted for performing the method of the invention.

Further features and advantages of the invention will appear more clearly on a reading of the following detailed description of a preferred embodiment of the invention, which is given by way of non-limiting example only and with reference to the accompanying drawing.

BRIEF DESCRIPTION OF THE DRAWING

The drawing consists of a single figure (FIG. 1) which shows diagrammatically a control system for the automatic stopping or (cut-out) of a motor vehicle starter in the preferred embodiment of the invention.

DESCRIPTION OF A PREFERRED EMBODIMENT OF THE INVENTION

Figure 1:
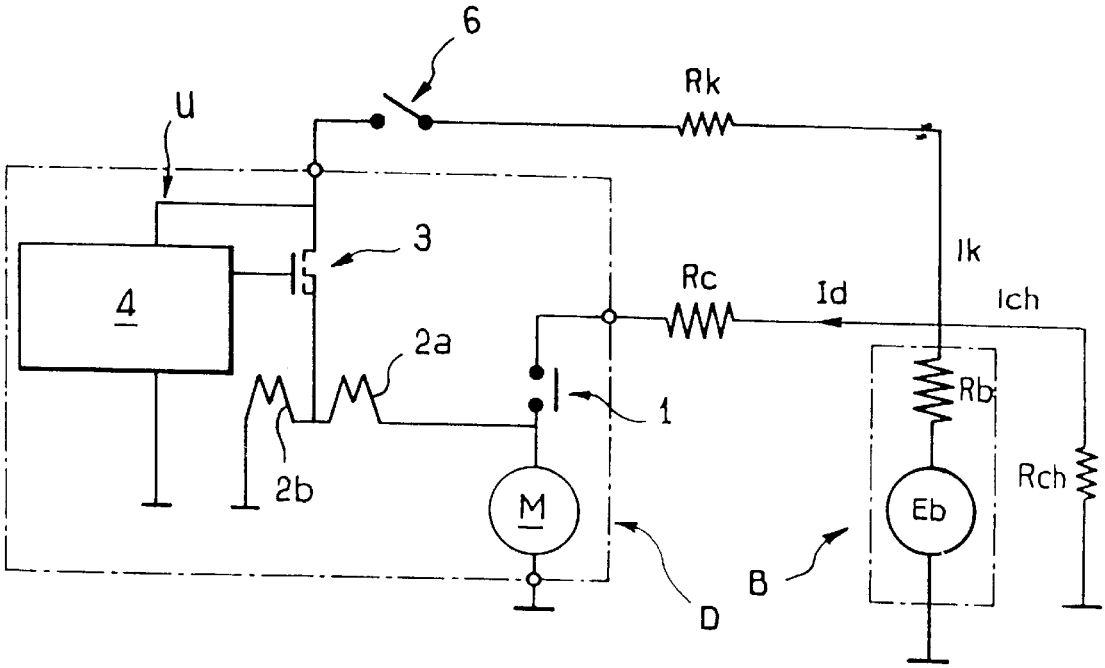

The drawing shows the electric motor M of a starter D. The motor M is connected in the normal way between a battery B of the vehicle and ground. The control system, for controlling the power supply to the motor, includes a starter contactor 1 which is connected between the battery B and the motor M.

The contactor 1 is part of a conventional relay which also includes an actuating winding 2*a* and holding winding 2*b*. One end of the actuating winding 2*a* is connected to a common point between the contactor 1 and the motor M. Its other end is connected firstly to the source of a MOSFET transistor 3, and secondly to the holding winding 2*b*. The other end of the holding winding 2*b* is connected to ground.

The drain of the transistor 3 is connected to the battery B through a cable, the supply of power to which is controlled by the ignition switch 6 of the vehicle. The grid of the transistor 3 is connected to the output of a signal generating unit 4, from which it receives a control voltage. It will of course be understood that the transistor 3 may be replaced by any other suitable type of controlled interrupter.

The signal generating unit 4 receives an input voltage U at the common point between the transistor 3 and the ignition switch, or main interrupter, 6, of the vehicle. The unit 4 generates the control voltage for the transistor 3 as a function of this voltage U, that is to say as a function of, firstly, the voltage of the battery B and secondly, the position of the ignition switch 6 of the vehicle.

The drawing also shows the following components of the circuit:

- the resistance Rk of the circuit branch containing the ignition switch 6, that is to say the wiring between the battery B and the transistor 3;
- the resistance Rc of the circuit branch between the battery and the contactor 1;
- a resistance Rch which is equivalent to the resistance of the remainder of the working, or current-consuming, circuits in the wiring network of the vehicle, which are connected in parallel with the motor M between the battery B and ground (for convenience, these circuits will be called "the other circuits");
- the internal resistance Rb and electromotive force Eb of the battery B.

Also indicated in the drawing are three currents Id, Ich and Ik. Id is the current absorbed by the starter motor M; Ich is the current absorbed by the other working components of the vehicle supplied through the other circuits, of which the combined resistance is Rch; and Ik is the current absorbed by the wiring of the branch containing the ignition switch 6.

The system also includes means which enable the current Ik to be measured by the signal generating unit 4. These measuring means consist for example of a shunt resistor connected between the ignition switch 6 and the transistor 3, but are not shown, so as to not to complicate the drawing unnecessarily. The signal generating unit 4 is for example a microprocessor of a suitable standard type.

The unit 4 performs the following process. When the ignition switch 6 is closed, the unit 4 controls the transistor 3, for example by means of a pulsed signal with modulated pulse widths, in such a way as to impose three different values in succession on the current Ik. The unit 4 measures the value of the voltage U for each of these three values of Ik. For example, a first measurement $U_0$ is made when Ik=0, a second measurement $U_1$ at an intermediate value $Ik_1$, and a third measurement $U_2$ is made at a value $Ik_2$ which is preferably as high as possible, and close to the lowest values of the current required in the actuating winding 2*a* to commence displacement of the moveable core of the relay to operate the contactor 1.

The current Id is of course zero before the contactor 1 is closed. In addition, the resistance Rch may be assumed to be stable during the engine starting operation.

The voltage $U_0$ which is obtained on the first measurement verifies the following equation, which is the equation of the closed circuit constituted by the battery and the resistance Rch:

$$U_0=Eb.Rb/(Rb+Rch). \quad (1)$$

The voltage $U_1$ obtained with the second measurement verifies, with the currents $Ich_1$ and $Ik_1$, in the circuit branches that correspond to the equivalent resistances Rch and Rk, the following relationships:

$$U_1=Eb+Rb.(Ich_1+Ik_1)+Rk.Ik_1. \quad (2)$$

$$0=Eb-Rb.(Ich_1+Ik_1)-Rch.Ich_1. \quad (3)$$

The voltage $U_2$ obtained on the second measurement verifies, with the current $Ich_2$ and $Ik_2$, in the circuit branches corresponding to the equivalent resistances Rch and Rk, the following relationships:

$$U_2=Eb+Rb.(Ich_2+Ik_2)+Rk.Ik_2. \quad (4)$$

$$0=Eb-Rb.(Ich_2+Ik_2)-Rch.Ich_2. \quad (5)$$

Equations (2) and (4) correspond to the equation of the battery/contactor circuit, while equations (3) and (5) correspond to the circuitry consisting of the battery and the other circuits, having the equivalent resistance Rch.

Thus, with the measurements of the voltages $U_0$, $U_1$ and $U_2$, five equations are available, from which the values of five unknowns Eb, Rb, Rch, $Ich_1$ and $Ich_2$ can be determined. In consequence, once the measurements of the voltages $U_0$, $U_1$ and $U_2$ have been effected, the signal generating unit 4 calculates the values of EMF Eb and the resistances Rb and Rch that characterise the electrical network of the vehicle, each time the engine is being started. The unit 4 then determines, as a function of these values, the threshold voltage Us for which, when it is reached by the voltage U, the unit 4 initiates cut-off of the power supply of the starter.

This threshold value Us is determined from the three following equations (6) to (8):

$$Us=Eb+Rb.(Ichs+Iks+Ids)+Rk.Iks. \quad (6)$$

$$0=Eb-Rb.(Ichs+Iks+Ids)-Rch.Ichs. \quad (7)$$

$$0=Eb-Rb.(Ichs+Iks+Ids)+(Rk+Rced).Iks \quad (8)$$

Equations (6) to (8) correspond, respectively, to the equations for the circuit comprising the battery B and the equivalent resistance Rk, the circuit comprising the battery B and the equivalent resistance Rch, and the circuit comprising the battery B, the equivalent resistance Rk and the transistor 3.

In equation (8), the resistance Rced is the resistance of the transistor 3. The values of Rced and those of Rds are data which are memorised beforehand in the unit 4.

It should be noted in particular that the value of the current Ids which is absorbed by the starter at the end of the starting operation depends only on the characteristics of the starter concerned, because, at that instant, the starter is no longer supplying energy to the engine of the vehicle. This value varies very little as a function of temperature. However, if desired, a correction can be applied according to the temperature if a greater degree of accuracy is required in the cut-off threshold of the starter.

Thus a control system for the cut off of the starter is provided which is based only on voltage measurements, and which uses a threshold value that represents, very well indeed, the current absorbed by the starter at the end of the starting operation.

It will also be noted that the various calculations for determination of the unknown parameters from equations (1) to (8) call for neither a high computing speed nor a large memory capacity.

Other versions of the method and apparatus, than those which have just been described, can of course be envisaged within the scope of the invention. In particular, instead of the various levels of the current Ik being governed by the signal generating unit 4, the values of the voltage $U_1$ and $U_2$ may be measured "in flight" during the rise in current in the actuating winding 2*a* of the contactor 1.

In another version, the number of equations and unknowns may be reduced by making certain approximations. For example it can be assumed, in the case of most vehicles, that the resistance of the wiring is in the range between 50 and 100 milliohms.

It is also possible to assume on some vehicles that the value of the current Ich is negligible, given that the closing of the ignition switch in its starting mode interrupts the power supply of all current consuming elements other than those which take part in the starting operations. The calculations to be carried out by the unit 4 are then simplified and therefore take a shorter time to process.

What is claimed is:

1. A method of controlling automatic cut out of a starter for an engine of a motor vehicle comprising:

measuring, once an ignition switch is closed, but prior to the supply of power to the starter, a power supply voltage for a plurality of values of current intensity in a first circuit connected to a power supply;

calculating, from the measured values, a threshold voltage as a function of parameters characterizing a wiring network connecting the power supply to the starter at the time of operation of the starter, with at least one said parameter being capable of being determined from the measurements; and supplying power to the starter until the power supply voltage reaches the threshold value.

2. A method according to claim 1, wherein, for the measurements of power supply voltage made prior to supplying power to the starter, the current in the network is governed in such a way as to impose on the network a plurality of given values of current.

3. A method according to claim 1, further comprising providing a relay having a starter contactor and at least one relay winding connected in said first circuit, the winding being adapted to open and close the contactor, wherein the voltage measurements carried out before power is supplied to the starter are effected for a plurality of values of current in the wiring of said first circuit by which power is supplied to the at least one relay winding, the measurements being carried out while current is rising in the at least one relay winding.

4. A method according to claim 1, wherein at least three said voltage measurements are made corresponding to three different values of current in the wiring network.

5. A method according to claim 1, wherein the step of calculating the threshold voltage comprises determining from the voltage measurements at least one parameter selected from the group consisting of the electromotive force of the battery, the internal resistance of the battery, and the equivalent resistance of the current-consuming elements in at least the first circuit of the vehicle network.

6. An apparatus for controlling the automatic stopping of a starter for an engine of a motor vehicle having a battery, a wiring network connected to the battery, the network comprising a plurality of circuits including a first circuit, with an ignition switch, and a starter circuit connecting a starter motor and a starter contactor of the starter, the apparatus comprising:

a signal generating unit including means for measuring the power supply voltage of the starter, and means for interrupting the power supply to the starter when the voltage reaches a threshold value, the said means for measuring the supply voltage being adapted so as, on closing of the ignition switch, but before the supply of power to the starter is commenced, to measure the voltage for several values of current in the first circuit, the unit further including means for calculating from the measured values, the value of the threshold voltage as a function of parameters characterizing the network at the time of operation of the starter.

7. An apparatus according to claim 6, wherein the unit includes means for governing the current in the network so as to impose thereon a plurality of given current values.

8. An apparatus according to claim 6, further comprising a relay having the starter contactor and at least one relay winding connected in said first circuit, the contactor being associated with the at least one winding so as to be opened and closed thereby, wherein the voltage measurements carried out before power is supplied to the starter are effected for a plurality of values of current in the wiring of said first circuit by which power is supplied to the at least one relay winding, the measurements being carried out while current is rising in the at least one relay winding.

9. An apparatus according to claim 6, wherein the unit is a microprocessor.

10. A method for automatically stopping a starter of an engine of a motor vehicle, the motor vehicle having a power supply, and a wiring network connected to the power supply, the method comprising:

calculating at least one parameter selected from the group consisting of the electromotive force of the battery, the internal resistance of the battery, and the equivalent resistance of the current-consuming elements in at least a first circuit of the wiring network;

calculating a threshold voltage from the at least one parameter; and interrupting power to the starter when power supply voltage reaches the threshold voltage.

11. A method according to claim 10, wherein calculating at least one parameter comprises measuring the power supply voltage for a plurality of values of current in the wiring network, after an ignition switch is closed, but before power is supplied to the starter.

12. A method according to claim 11, further comprising imposing a plurality of current values on the network.

13. A method according to claim 10, wherein calculating at least one parameter comprises measuring the voltage while current is rising in an at least one winding of a relay connected to a starter contactor and to the wiring network, and wherein interrupting power to the starter comprises opening the contactor.

14. A method according to claim 10, wherein calculating at least one parameter comprises measuring three voltages corresponding to three current values.

15. A device for automatically stopping a starter of an engine of a motor vehicle, the motor vehicle having a power supply, and a wiring network connected to the power supply, the device comprising:

a voltage measurer adapted to measure the power supply voltage for several values of current in a first circuit of the wiring network when an ignition switch is closed to bring the power supply into electrical connection with the wiring network, but before power reaches the starter; and a unit adapted to calculate a threshold voltage based on voltage measurements by said voltage measurer; and a power supply interrupter adapted to interrupt power to the starter when the power supply voltage reaches the threshold voltage.

16. The device according to claim 15, wherein the voltage measurer is adapted to impose a plurality of current values on the network.

17. The device according to claim 15, wherein the power supply interrupter comprises a relay having at least one winding, the relay being connected to a contactor of the starter and adapted to open and close the contactor; and wherein the voltage is measured while current is rising in the at least one winding is increasing.

18. The device according to claim 15, wherein the unit is a microprocessor.

* * * * *